US008303212B2

(12) United States Patent
Lara

(10) Patent No.: US 8,303,212 B2
(45) Date of Patent: Nov. 6, 2012

(54) BOOM MOORING SYSTEM

(76) Inventor: Kim A. Lara, Kodiak, AK (US)

( * ) Notice: Subject to any disclaimer, the term of this patent is extended or adjusted under 35 U.S.C. 154(b) by 226 days.

(21) Appl. No.: 12/775,294

(22) Filed: May 6, 2010

(65) Prior Publication Data

US 2011/0274494 A1 Nov. 10, 2011

(51) Int. Cl.
*E02B 15/04* (2006.01)

(52) U.S. Cl. ..... 405/70; 405/63

(58) Field of Classification Search ..... 405/60, 405/63, 64, 65, 70, 71, 72
See application file for complete search history.

(56) References Cited

U.S. PATENT DOCUMENTS 3,779,020 A * 12/1973 Muramatsu et al. ..... 405/64
3,807,178 A * 4/1974 Tanksley ..... 405/70
3,848,417 A * 11/1974 Smith et al. ..... 405/70
3,973,406 A * 8/1976 Casey ..... 405/70
4,016,726 A 4/1977 Campbell
4,133,765 A * 1/1979 Stupica ..... 405/63
4,174,185 A * 11/1979 Toki ..... 405/63
4,398,844 A * 8/1983 Jaffrennou et al. ..... 405/72
4,422,797 A * 12/1983 McAllister et al. ..... 405/70
2004/0120770 A1 6/2004 Miyazaki

FOREIGN PATENT DOCUMENTS

WO WO 9429531 A1 * 12/1994
WO WO 2007065203 A1 * 6/2007

* cited by examiner

*Primary Examiner* — Frederick L Lagman
(74) *Attorney, Agent, or Firm* — Neustel Law Office

(57) ABSTRACT

A boom mooring system for anchoring containment booms over extended periods and in varying sea conditions. The system generally includes a buoy having a frame, a buoyancy member mounted thereto, connecting plates located on first and second ends of the frame for connecting containment booms, and an anchor secured to the frame for mooring the buoy. The frame evenly distributes stresses caused from securely anchoring the containment boom in a dynamic sea environment. The anchor may be secured to the frame in various manners, such as via a pipe movably extending through the frame or an elongated member, such as a rope, cable, etc. secured to the frame or pin of the frame. Various signaling devices may extend from the buoy, such as lights, flags, etc. to designate presence of the buoys and containment boom and/or to designate openings in the containment boom to allow passage of spill response vessels.

18 Claims, 9 Drawing Sheets

BOOM MOORING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a containment boom and more specifically it relates to a boom mooring system for efficiently anchoring containment booms over extended periods of time and in varying sea conditions.

2. Description of the Related Art

Any discussion of the related art throughout the specification should in no way be considered as an admission that such related art is widely known or forms part of common general knowledge in the field.

Containment booms have been in use for years and are typically utilized to contain leaked or spilled contaminants or substances, such as oil, within water bodies. The containment booms are generally comprised of elongated sections adapted to float in the water in a semi-rigid manner and generally have an anchoring system extending from the underside of the sections along the length of the sections.

One problem with existing anchoring systems is that because the anchoring system is affixed to the underside of the containment boom, the weight of the anchoring system must be minimal to avoid ripping or tearing the containment boom, as well as to allow movement of the containment boom through the water body. Because of the lightweight anchoring system, the containment booms often times cannot be efficiently anchored during rough sea conditions. Because of the inherent problems with the related art, there is a need for a new and improved boom mooring system for efficiently anchoring containment booms over extended periods of time and in varying sea conditions.

BRIEF SUMMARY OF THE INVENTION

A system for efficiently anchoring containment booms over extended periods of time and in varying sea conditions. The invention generally relates to a containment boom which includes a buoy having a frame, a buoyancy member mounted on the frame, connecting plates located on first and second ends of the frame for connecting containment booms to the frame, and an anchor secured to the frame for mooring the buoy. The interconnecting frame will help to evenly distribute stresses caused from securely anchoring the containment boom in a dynamic sea environment. The anchor may be secured to the frame in various manners, such as a pipe movably extending through the frame or an elongated member, such as a rope, cable, etc. secured to the frame or pin of the frame. The buoyancy member may include a protective coating thereon. Various signaling devices may also extend from the buoy, such as lights, flags, etc. to designate presence of the buoys and containment boom and/or to designate openings in the containment boom to allow passage of spill response vessels.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
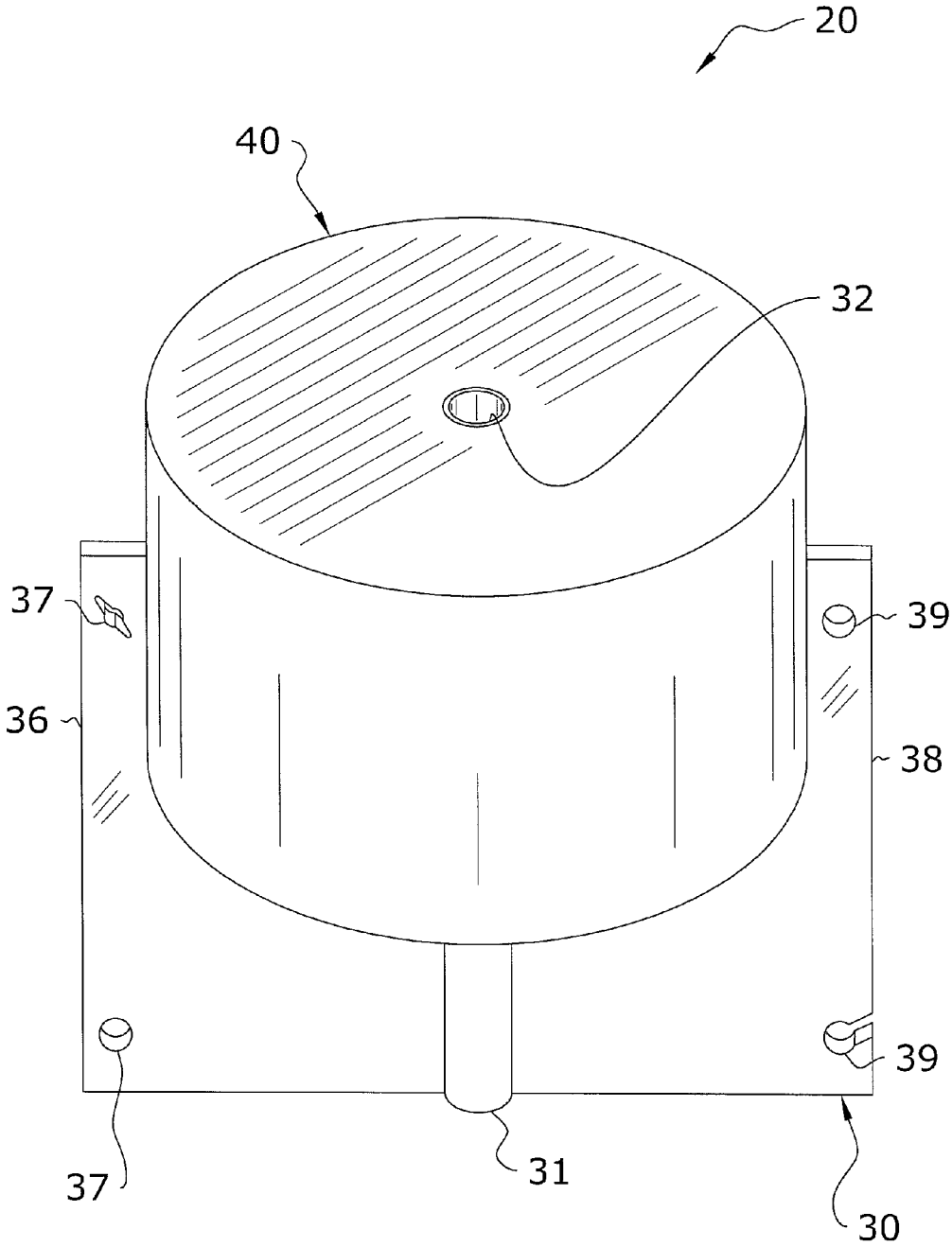
FIG. 1 is an upper perspective view of the buoy.

Turning now descriptively to the drawings, in which similar reference characters denote similar elements throughout the several views, FIGS. 1 through 9 illustrate a boom mooring system 10, which comprises a buoy 20 having a frame 30, a buoyancy member 40 mounted on the frame 30, connecting plates 36, 38 located on first and second ends of the frame 30 for connecting containment booms 12 to the frame 30, and an anchor 60 secured to the frame 30 for mooring the buoy 20. The anchor 60 may be secured to the frame 30 in various manners, such as a pipe 64 movably extending through the frame 30 or an elongated member 62, such as a rope, cable, etc. secured to the frame 30 or pin 50 of the frame 30.

The buoyancy member 40 may include a protective coating 44 thereon. Various signaling devices may also extend from the buoy 20, such as lights, flags, etc. to designate presence of the buoys 20 and containment boom 12 and/or to designate openings in the containment boom 12 to allow passage of spill response vessels. The present invention may be used within various types of bodies of water, such as seas, lakes, oceans, rivers, ponds, etc. The containment booms 12 are generally comprised of conventional containment booms and thus are not described in detail herein.

The buoyancy member 40 is further water impermeable to prevent the contaminants (e.g. oil) from soaking through. To provide the water impermeable structure, the buoyancy member 40 may be water impermeable, the coating 44 may be water impermeable, an impermeable caulking (not shown) may be used or the buoyancy member 40 may be surrounded with water impermeable structures (not shown).

B. Buoy

The buoys 20 are constructed to interconnect containment booms 12 generally used in bodies of water to contain contaminants, such as oil spills, etc. and anchor 60 the containment booms 12 in place and distribute the strain caused by the anchor 60 in heavy or rough seas. The buoys 20 are adapted to withstand harsh environments and prolonged periods in water. The buoys 20 are also adapted to withstand excessive engagement by water, floating debris, the containment booms 12, etc. without becoming structurally damaged or losing floating or supporting properties. The containment booms 12 attach to the buoys 20 in a manner wherein the buoyant part of the containment booms 12 is level with the a similar height portion of the buoyancy member 40 of the buoy 20 so that the buoy does not cause the containment boom 12 to lift out of or be sunken within the water.

The buoy 20 generally includes a frame 30 for supporting a buoyancy member 40 which maintains the buoy 20 afloat. The frame 30 is generally comprised of an aluminum material to provide a lightweight, strong, and rust free material.

The frame 30 generally includes a receiver member 31 centrally positioned upon the frame 30 and extending vertically from a lower end to an upper end of the frame 30. The receiver member 31 is generally comprised of a tubular structure and has a cylindrical passageway 32 extending therethrough; however it is appreciated that the receiver member 31 may take the form of various shapes. The receiver member 31 generally is used to connect the buoy 20 to the anchor 60 via various methods as will be described herein.

The frame 30 generally includes a plurality of flanges 33 projecting outwardly from the receiver member 31 and circumscribing the receiver member 31. The flanges 33 are generally comprised of a ring-shaped structure and are spaced along the longitudinal length of the receiver member 31. The flanges 33 extends outwardly from the frame 30 to support the buoyancy member 40 in position and prevent the buoyancy member 40 from moving relative the frame 30.

The frame 30 also includes an upper support 34 and a skirt 35 each vertically spaced apart in a parallel manner and laterally extending from both sides of the receiver member 31. The upper support 34 and the skirt 35 are generally located near an upper and lower end of the receiver member 31 and the receiver member 31 is generally centrally located along the upper support 34 and the skirt 35. The upper support 34 provides additional support to the buoyancy member 40. The skirt 35 is meant to align with the skirt of the containment boom 12 and generally extends below the buoyancy member 40 to be located under the water surface. The upper support 34 and the skirt 35 also connect the receiver member 31 of the frame 30 to the connecting plates 36, 38 located upon lateral first and second ends of the frame 30.

The frame 30 includes a first connecting plate 36 located along a first end for connecting to a first containment boom 12 and a second connecting plate 38 located along a second end for connecting to a second containment boom 12, wherein the frame 30 is connected between adjacent containment booms 12 and serves to support the containment booms 12 in relative position to one another and serve as a point to anchor 60 the adjacent containment booms 12.

The first connecting plate 36 and the second connecting plate 38 are each preferably vertically oriented. The face or front side of the first connecting plate 36 and the second connecting plate 38 is also parallel to a line formed by the containment boom 12 so that the frame 30 follows a linear path of the containment boom 12. It is appreciated that various other types of structures may be used on the first and second lateral ends of the frame 30 rather than the connecting plates 36, 38 as illustrated.

Each of the connecting plates 36, 38 generally include multiple connectors 37, 39 for securing a respective containment boom 12 thereto. The connectors 37, 39 may be comprised of openings, slots, fasteners, nuts, bolts, rope, cable, quick connect structures, ties, various combinations thereof, or various other structures of differing sizes and shapes, all which efficiently allow connection of the connecting plates 36, 38 to adjacent containment booms 12. It is appreciated that different style or brand containment booms 12 have different types of connectors (e.g. ASTM connectors, F962 ASTM connector, F2438 ASTM connector, etc.) and thus the connectors 37, 39 of the connecting plates 36, 38 may be formed in various sizes, shapes, materials, or structures, to mate with appropriate connectors along the ends 13 of the containment booms 12.

Figure 2:
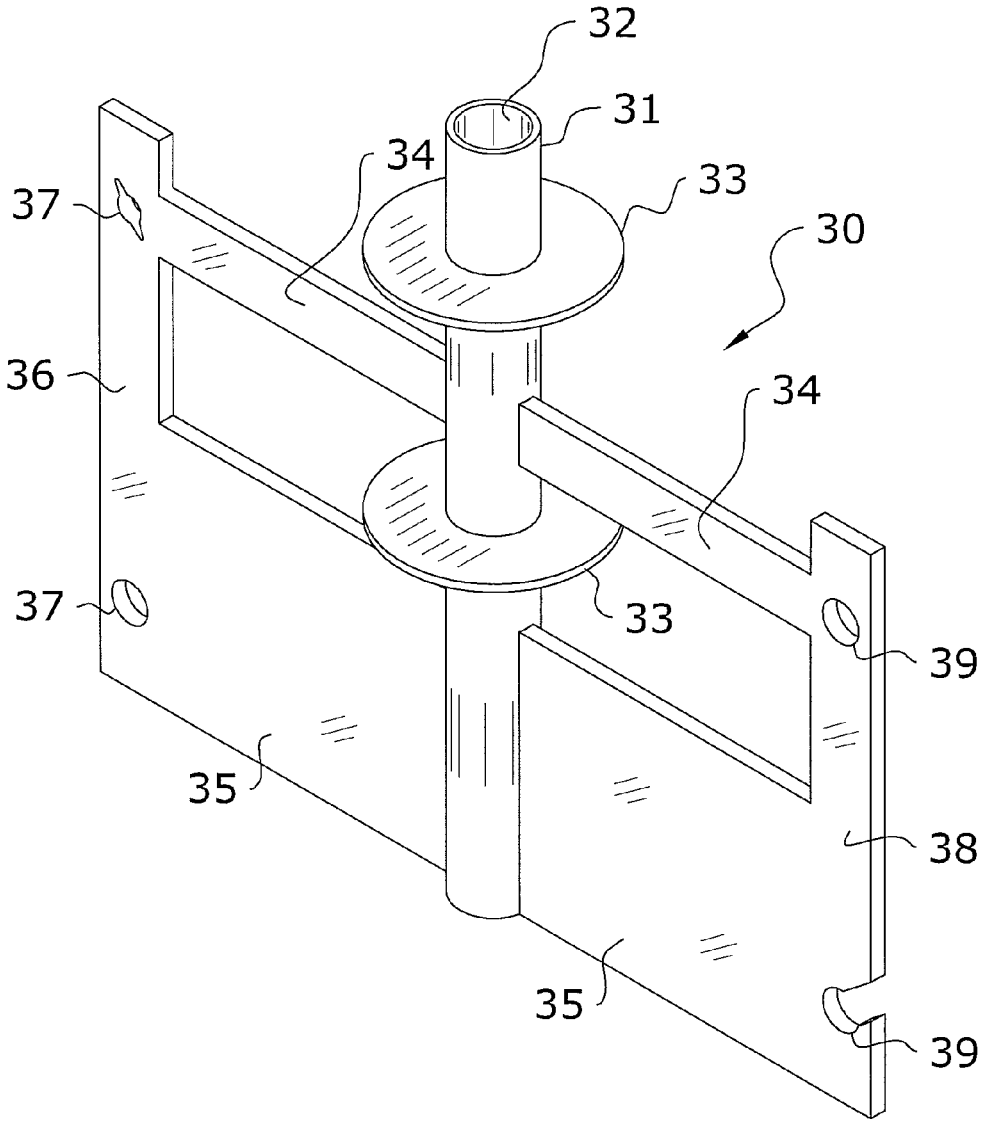
FIG. 2 is an upper perspective view of the frame.
Figure 3:
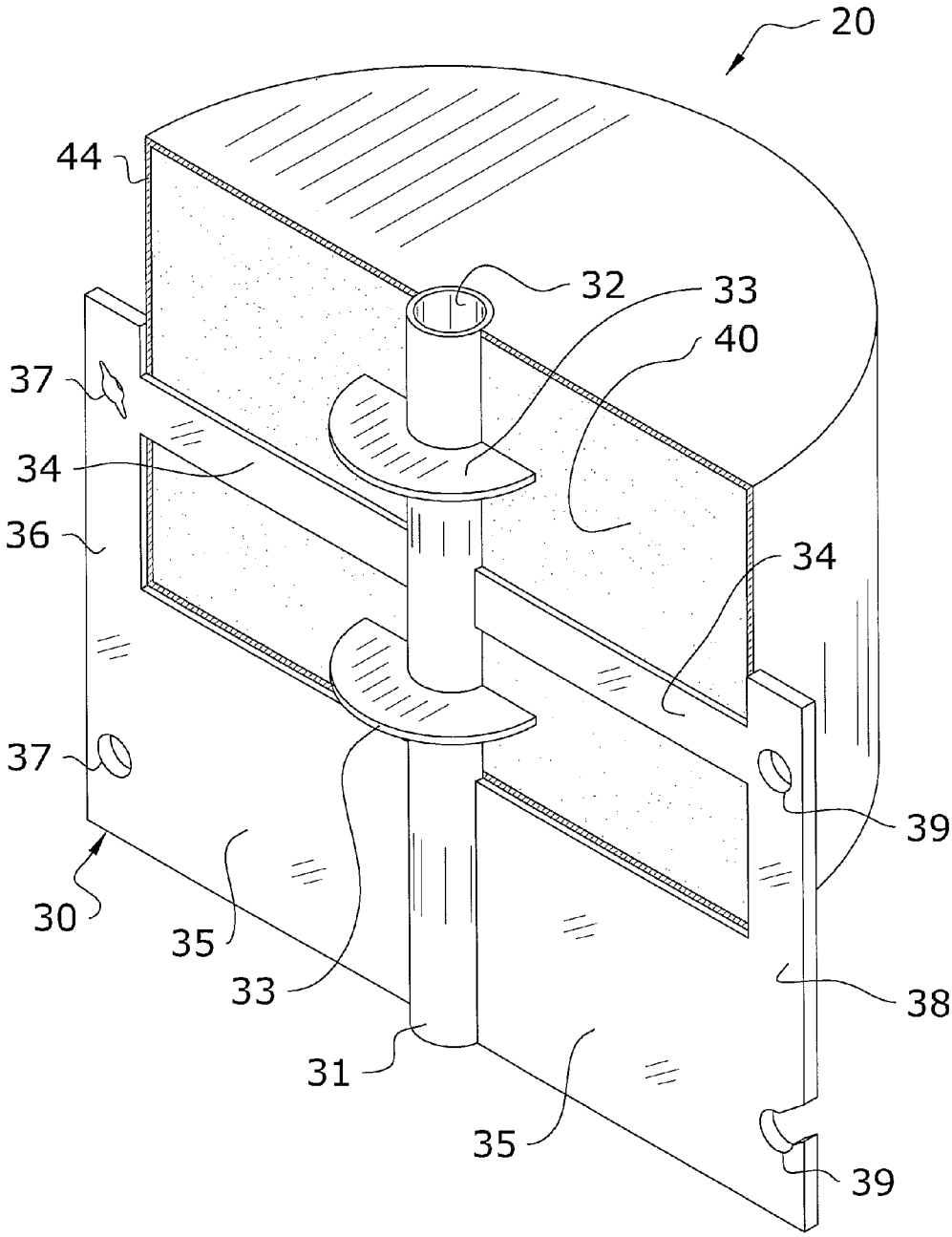
FIG. 3 is an upper perspective view of the frame and buoyancy member with coating cutaway.
Figure 4:
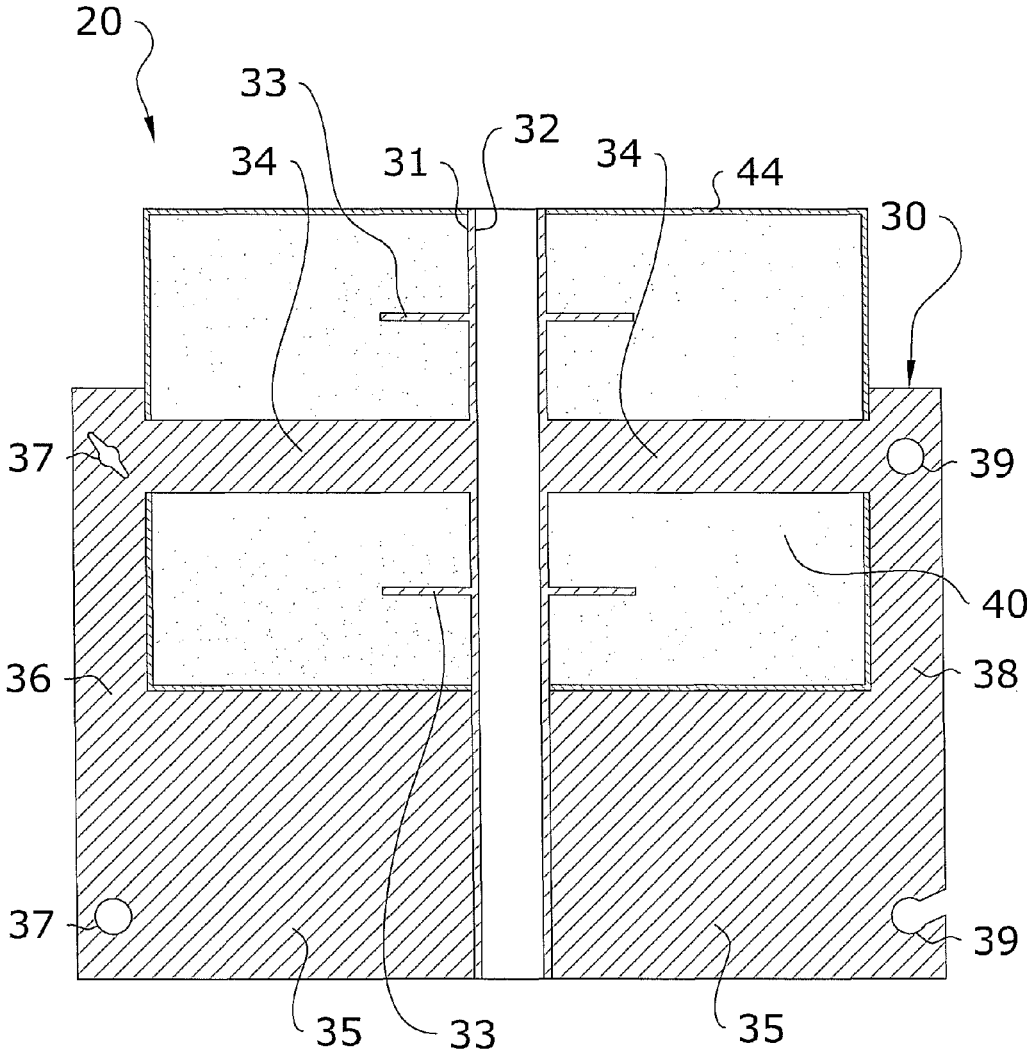
FIG. 4 is a side sectional view of the buoy.

The FIGS. 1 through 3 illustrate multiple shaped openings as the connectors 37, 39. It is appreciated that the multiple shaped openings are for illustrative purposes to exemplify that the openings could be various shapes, sizes, etc., or rather be a different structure than an opening. Further, the frame 30 may include all the same connectors 37, 39, different connectors 37, 39, or more or less connectors 37, 39 than illustrated.

The buoyancy member 40 is formed around the frame 30 and particularly formed around the receiver member 31, upper support 34, and skirt 35 in a manner wherein the top of the buoyancy member 40 is level with the top of the receiver-member 31 and the bottom of the buoyancy member 40 is level with the top of the skirt 35. The buoyancy member 40 further employs a circular cross-section to form a cylindrical or disk shaped structure; however various other shapes may be appreciated. The buoyancy member 40 is generally formed around the frame 30 in a mold using a closed cell foam material. It is appreciated that various buoyant materials may be utilized all which are able to remain buoyant over extended periods of time, such as by not becoming water-logged, and are able to support large amounts of weight.

The buoy 20 also preferably includes a coating 44 surrounding the buoyancy member 40 for added protection of the buoyancy member 40 by forming a hard outer shell around the buoyancy member 40. The coating 44 is generally comprised of polyurethane, ceramic or hard spray-on or dip coating 44, such as produced by RHINO™ for pickup bed lining. The coating 44 preferably entirely covers the outer surface of the buoyancy member 40 to protect and add additional waterproofing to the buoyancy member 40.

C. Anchor Retaining Structures

Various types of anchor retaining structure may be utilized with the buoy 20 to prevent the containment booms 12 from moving the buoys 20 when connected thereto. The anchor retaining structures may be utilized in deep or shallow waters and during rough or calm sea conditions.

Figure 5:
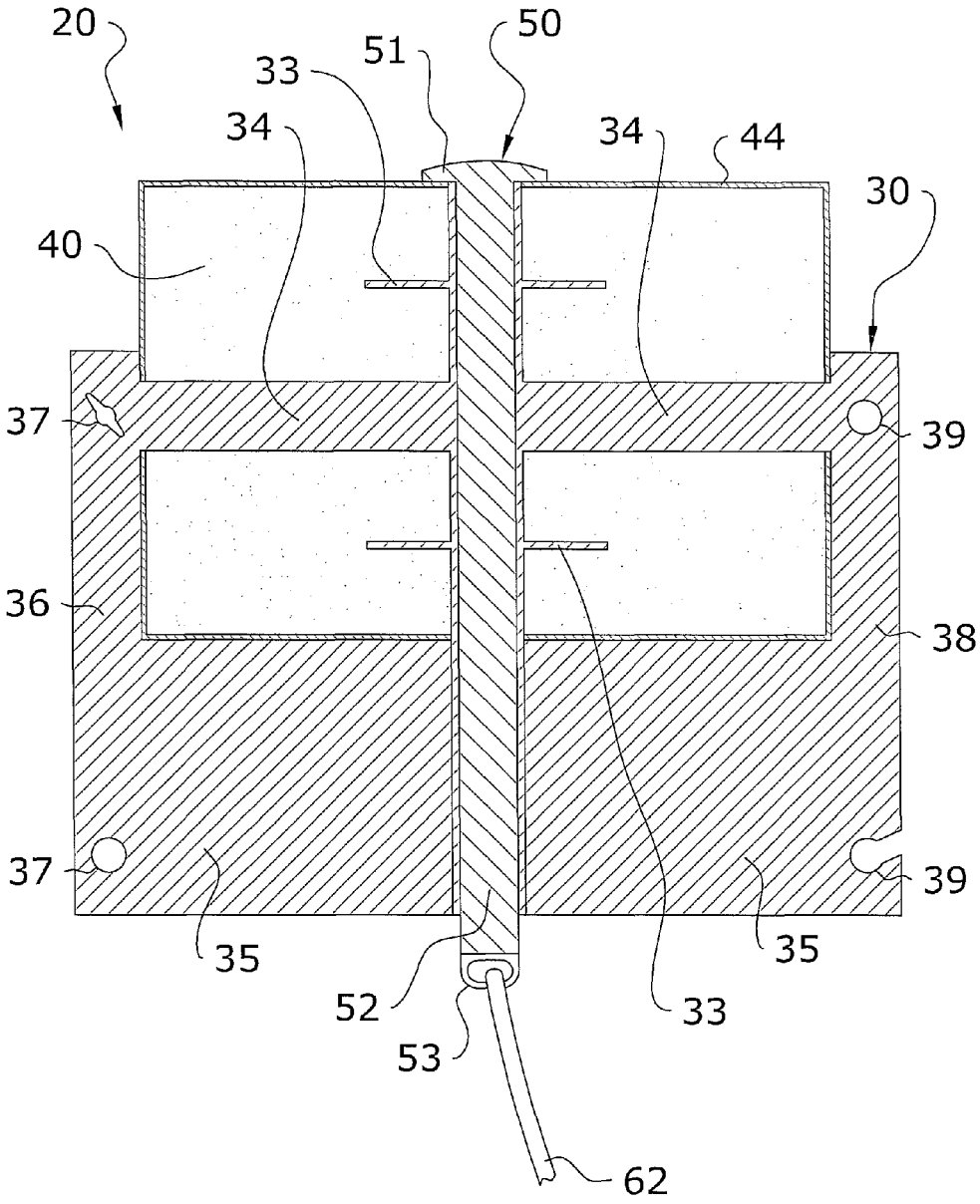
FIG. 5 is a side sectional view of the buoy with the pin inserted.
Figure 6:
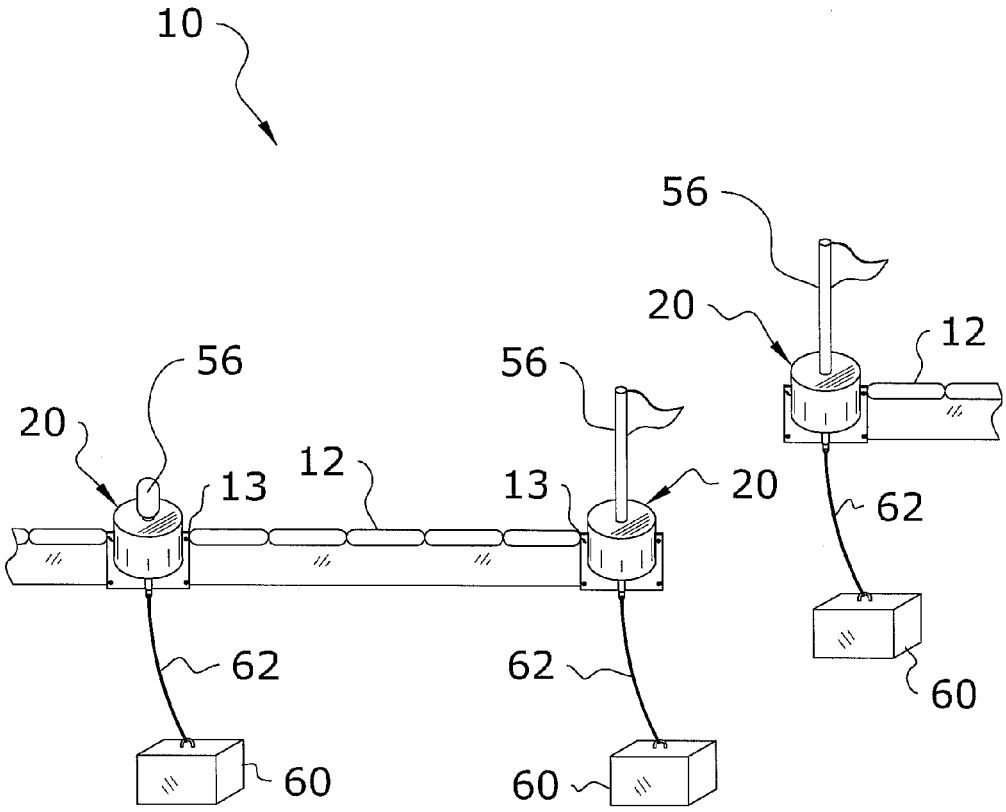
FIG. 6 is an upper perspective view of the present invention in use with the pins and showing an opening formed between buoys and marked via flags.

One type of anchor retaining structure as illustrated in FIGS. 5 and 6 utilizes a pin 50 that is extended from the top down through the passageway 32 of the receiver member 31 of the frame 30. The pin 50 includes a head 51 formed on one end to rest upon the top surface of the receiver member 31, an elongated shaft 52 slidably extending from the head 51 to extend through the passageway 32, and a ring connector 53 extending from the lower end of the shaft 52 opposite the head 51. It is appreciated that various types of connectors 37, 39 may be utilized other than those that are ring shaped. The pin 50 is thus removable from the frame 30 by simply upwardly extending the pin 50 out of the receiver member 31.

The ring connector 53 generally attaches to a first end of an elongated member 62, such as a cable, rope, chain, etc., wherein the second end of the elongated member 62 is secured to an anchor 60, such as a cement block, etc. The anchor 60 is either rested upon the floor of the body of water or suspended within the body of water. The weight of the anchor 60 retains the pin 50 within the receiver member 31 by pulling downward upon the pin 50 so that the head 51 maintains contact with the upper end of the receiver member 31.

Figure 7:
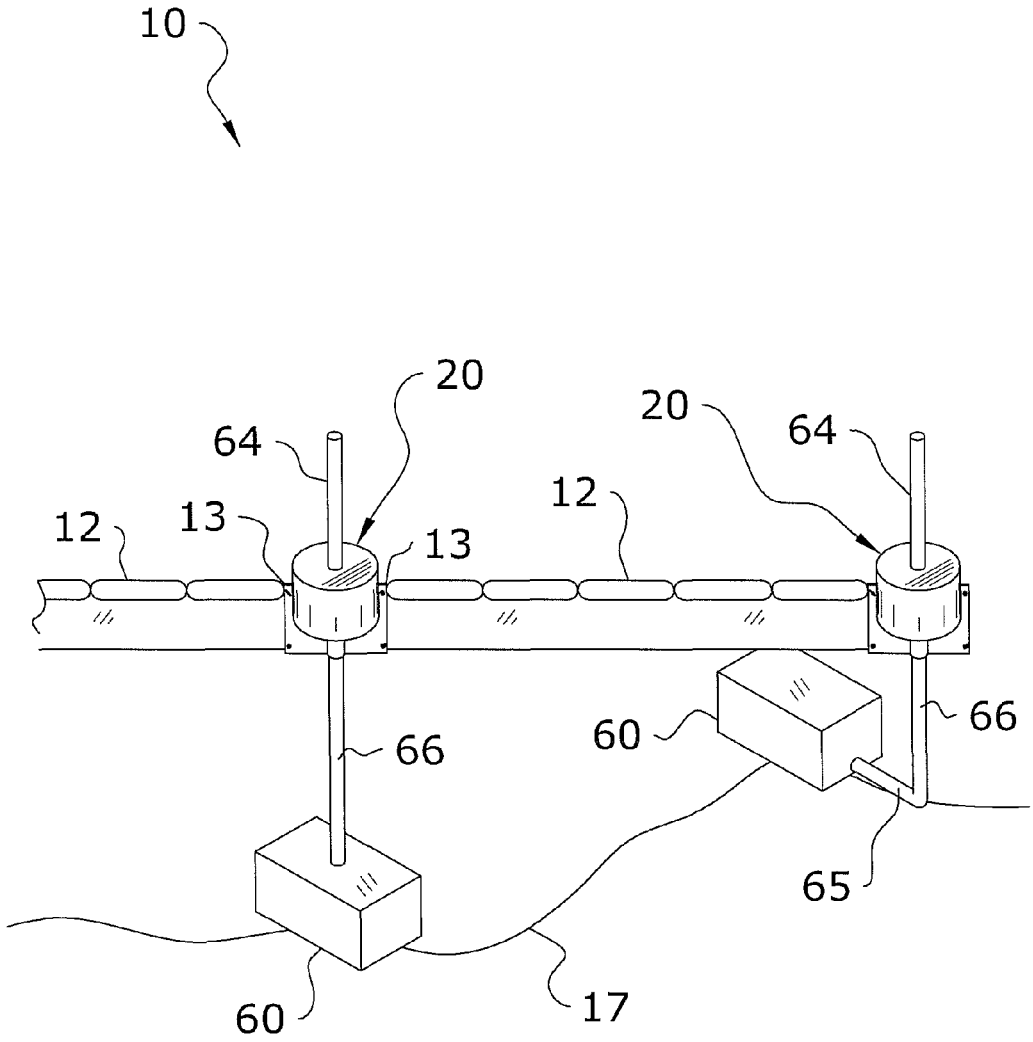
FIG. 7 is an upper perspective view of the present invention in use with the pipes in shallow water showing the buoys and containment booms in a raised position with high sea levels.
Figure 8:
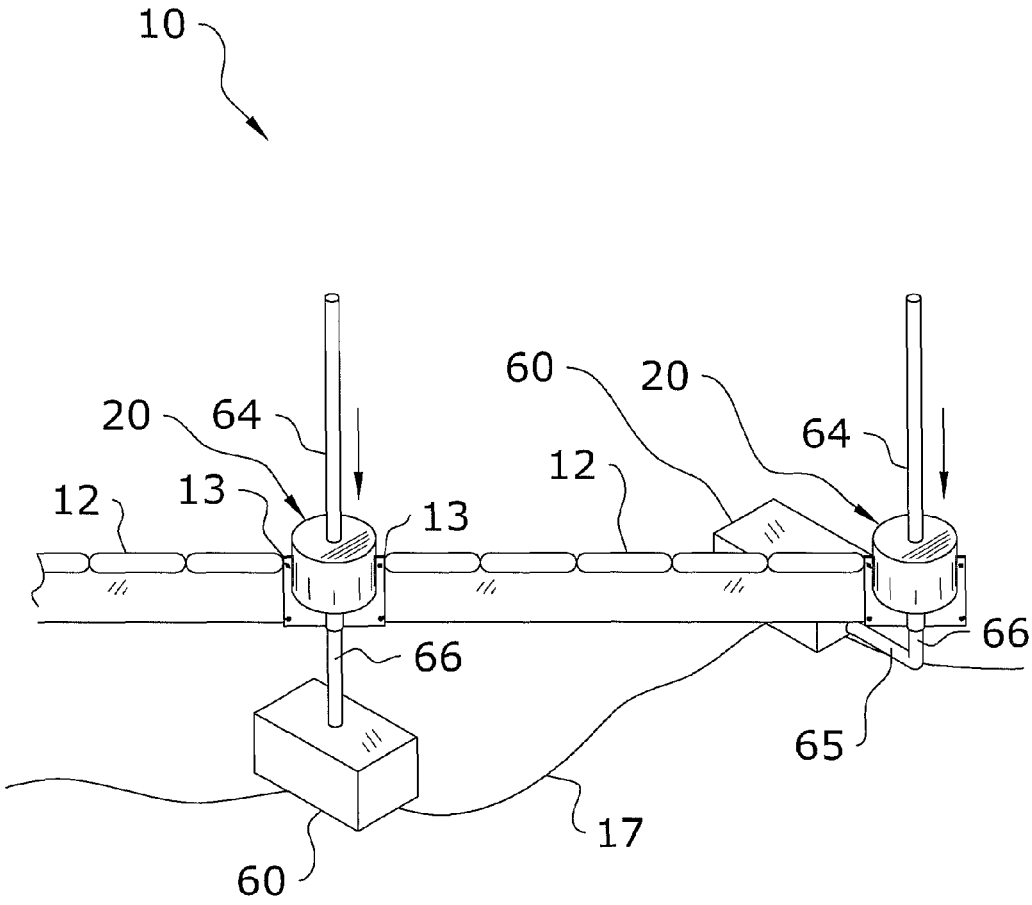
FIG. 8 is an upper perspective view of the present invention in use with the pipes in shallow water showing the buoys and containment booms in a lowered position with low sea levels.

Another type of anchor retaining structure is illustrated in FIGS. 7 and 8 includes the use of an anchor 60 generally located upon the floor surface 17 of the body of water and a pipe 64 extending upwardly from the anchor 60 to be received through and secured within the passageway 32 of the receiver member 31. The buoy 20 is thus able to vertically self adjust by moving up and down the pipe 64 with changing sea levels. The pipe 64 may extend upwardly from the top of the anchor 60 or from the side of the anchor 60. In areas where extreme low water is common, it may be necessary to offset the pipe 64 from the bottom of the anchor 60 by having a horizontal portion 65 extending laterally outward from near the bottom of the anchor 60 and then having a vertical portion 66 extending upwardly therefrom and through the receiver member 31.

Figure 9:
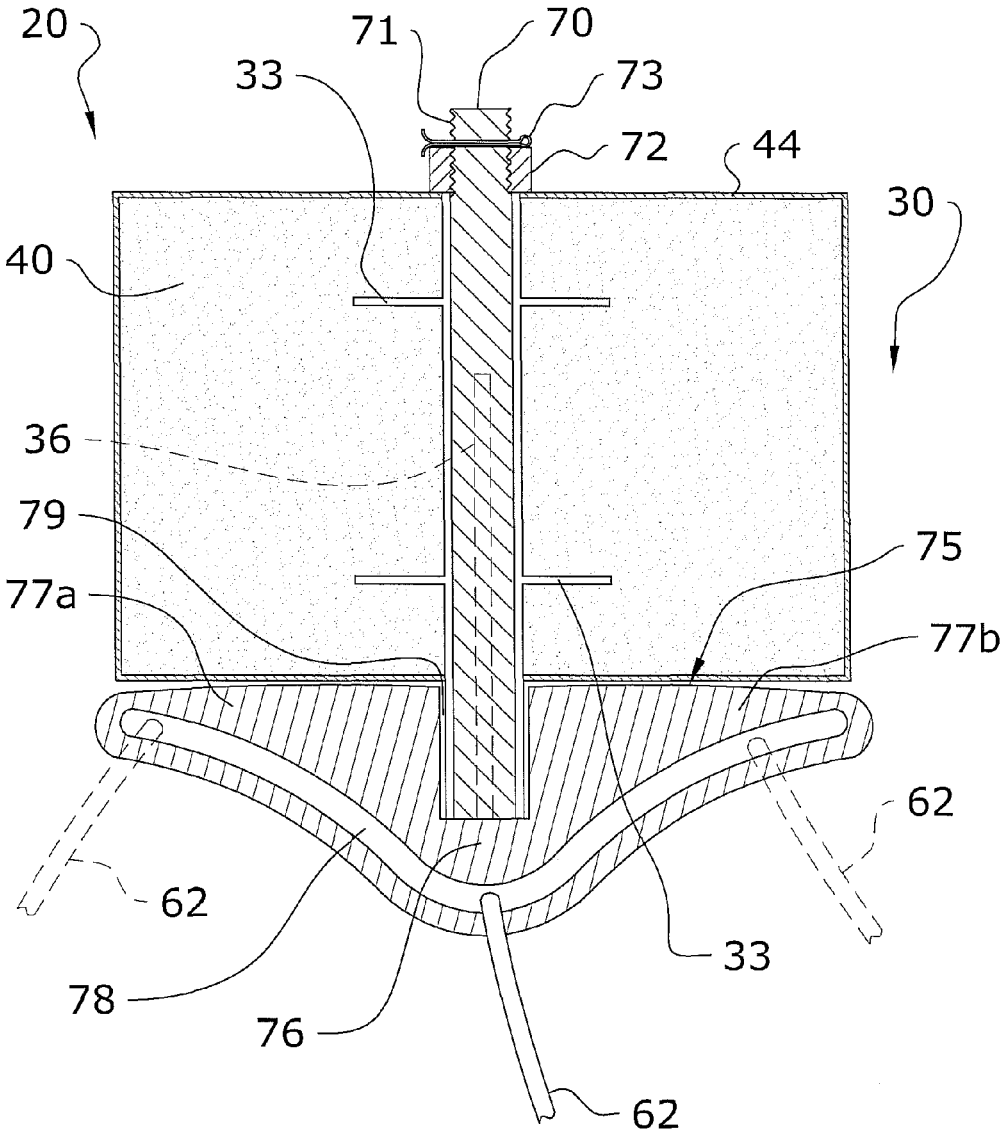
FIG. 9 is a sectional view of the buoy with an alternate anchor retaining structure.

Another type of anchor retaining structure as illustrated in FIG. 9 is inserted within the bottom of the receiver member 31 and allows the anchor shackle (connector not shown at the upper end of the elongated member 62) to slide up to a higher position and pull on the buoy 20 more evenly keeping the containment boom 12 upright in varying sea conditions. The retaining structure generally includes an elongated pin 70 having a threaded end 71 that is extended above the receiver member 31. The threaded end 71 receives a nut 72 and a retaining pin 73 to secure the pin 70 within receiver member 31 and ensure the pin 70 is not able to move vertically.

Extending from a lower end of the pin 70 is a retainer 75. A gap 79 is formed between a center portion 76 of the retainer 75 and the lower end of the pin 70 to receive the lower end of the receiver member 31 and allow the retainer 75 to be slid upwards along the receiver member 31 next to the buoyant member 40. The retainer 75 generally traverses the skirt 35. The retainer 75 includes the center portion 76 as well as wings 77*a*, 77*b* extending outwardly therefrom.

The bottom of the retainer 75 is generally curved, wherein a slot 78 extending along the length of the retainer 75 from the first wing 77*a* to the center portion 76 to the second wing 77*b* (i.e. first end to a second end of the retainer 75) follows the shape of the curved bottom of the retainer 75. The anchor shackle or end of the elongated member 62 is secured within the slot 78 and is able to move forward and backward as well as vertically up and down with rough sea conditions thus providing less stress upon the buoy 20 so that the buoy 20 may remain in an upright orientation.

It is appreciated that the pin 70 may be eliminated and the retainer 75 simply affixed to the bottom of the frame 30. Various other pendulum devices may additionally be used. It is also appreciated that the upper end of the elongated member 62 or anchor shackle (not shown) may be attached to the frame 30 in various alternate locations or in various alternate manners.

Various types of markers 56, such as lights or flags may be incorporated into the pin 50, 70 or frame 30 such as by extending upwardly therefrom. The markers 56 may be utilized to designate presence of the buoys 20 and containment booms 12 and/or to designate openings in the containment boom 12 to allow passage of spill response vessels.

D. Operation of Preferred Embodiment

In use, the containment booms 12 are arranged in a preferred manner to surround a particular area of the body of water, such as an area contaminated with an oil spill. The buoys 20 are then located between each pair of adjacent containment booms 12 and the connecting ends 13 of the containment booms 12 are connected to the first and second ends of the frame 30 using the connecting plates 36, 38, connectors 37, 39, or various other fastening elements.

The containment booms 12 are generally able to pivot horizontally and slightly vertically with respect to the buoy 20 to accommodate for rough sea conditions. Each buoy 20 is also anchored in place via extending the post 64 through the receiver member 31, by extending the pin 50 within the receiver member 31 and fastening an elongated member 62 thereto, wherein the elongated member 62 is secured to an anchor 60 on an opposing end, or by using another type of slidable means within the receiver member 31.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A buoy for anchoring containment booms, comprising:
- a frame having a first end and a second end;
- a buoyancy member mounted on said frame;
- a connecting means located on said first end and said second end of said frame for connecting adjacent containment booms to said frame; and
- an anchor retaining means secured to said frame for mooring said buoy, wherein said frame includes a tubular receiver member for securing said anchor retaining means, wherein said tubular receiver member is vertically oriented.

2. The buoy of claim 1, wherein said tubular receiver member is centrally positioned between said first end and said second end.

3. The buoy of claim 1, wherein said frame includes:
- a first cross support to connect an upper end of said connecting means; and
- a second cross support to connect a lower end of said connecting means.

4. The buoy of claim 3, wherein said second cross support extends substantially further along a height of said frame.

5. The buoy of claim 1, wherein said anchor retaining means includes a pin.

6. The buoy of claim 5, wherein said pin is slidably received within said frame.

7. The buoy of claim 6, wherein said pin is vertically oriented.

8. The buoy of claim 7, including a retainer extending from the lower end of said pin.

9. The buoy of claim 8, wherein said retainer is comprised of a ring.

10. The buoy of claim 8, wherein said retainer includes:

a center portion;

a first wing extending from said center portion;

a second wing extending from said center portion; and a slot extending through said first wing, said second wing, and said center portion.

11. The buoy of claim 10, wherein said retainer is traverse to said frame.

12. The buoy of claim 1, including a signaling marker extending upwardly from said frame.

13. The buoy of claim 1, wherein said retaining means includes:

an elongated pipe received by said frame;

wherein said pipe extends from an anchor that rests on a floor surface of a body of water.

14. The buoy of claim 1, including a coating to cover said buoyancy member.

15. The buoy of claim 1, wherein said buoyancy member is comprised of a closed cell foam material.

16. A buoy for anchoring containment booms, comprising:

a frame having a first end and a second end;

wherein said frame includes a receiver member having a passageway therethrough;

wherein said receiver member is vertically oriented and substantially centered between said first end and said second end;

a buoyancy member mounted on said frame;

wherein said buoyancy member surrounds said receiver member of said frame;

connecting means located on said first end and said second end of said frame for connecting adjacent containment booms to said frame;

wherein said connecting means extends laterally outwardly from said buoyancy member;

an anchor retaining means received by said receiver member through said passageway; and an anchor secured to said anchor retaining means for mooring said buoy.

17. The buoy of claim 16, wherein said anchor retaining means includes a pin.

18. A boom mooring system for anchoring containment booms used to contain contaminants within a body of water, comprising:

a first containment boom having a first connecting end;

a second containment boom having a second connecting end;

a buoy having an aluminum frame, a closed cell foam buoyancy member partially surrounding said frame, and a protective coating covering said buoyancy member;

wherein said frame includes a first end and a second end;

a first connecting means located on said first end of said frame for connecting to said first connecting end of said first containment boom;

a second connecting means located on said second end of said frame for connecting to said second connecting end of said second containment boom;

wherein said frame includes a receiver member having a passageway therethrough;

wherein said receiver member is vertically oriented and substantially centered between said first end and said second end;

an upper cross support connecting said first connecting means to said second connecting means adjacent an upper end of said receiver member;

a skirt connecting said first connecting means to said second connecting means adjacent a lower end of said receiver member;

wherein said first cross support is parallel to said second cross support;

wherein said receiver member is centered along said first cross support and said second cross support and wherein said receiver member is connected to said first cross support and said second cross support;

wherein said skirt is positioned below a water surface;

wherein said frame includes a plurality of circular flanges extending from said receiver member;

wherein said buoyancy member surrounds a portion of said receiver member, said plurality of flanges, and said first cross support of said frame;

wherein a top of said buoyancy member is level with said upper end of said receiver member and wherein a bottom of said buoyancy member is level with a top of said skirt;

wherein said buoyancy member has a circular cross-section;

wherein said buoyancy member is positioned above a water surface;

an anchor retaining means received by said receiver member through said passageway; and an anchor secured to said anchor retaining means for mooring said buoy, said first containment boom, and said second containment boom.

* * * * *